United States Patent [19]

Fujiwara et al.

[11] Patent Number: 4,664,725

[45] Date of Patent: May 12, 1987

[54] NITROGEN-CONTAINING DUAL PHASE STAINLESS STEEL WITH IMPROVED HOT WORKABILITY

[75] Inventors: Kazuo Fujiwara, Kobe; Haruo Tomari, Hyogo; Takenori Nakayama, Kobe, all of Japan

[73] Assignee: Kabushiki Kaisha Kobe Seiko Sho, Kobe, Japan

[21] Appl. No.: 795,413

[22] Filed: Nov. 6, 1985

[30] Foreign Application Priority Data

Nov. 28, 1984 [JP] Japan ..... 59-252245

[51] Int. Cl.[4] ..... C22C 38/44

[52] U.S. Cl. ..... 148/325; 148/327

[58] Field of Search ..... 75/128 E, 128 A, 128 N; 148/37, 38, 325, 327; 420/56, 57, 67, 41

[56] References Cited

U.S. PATENT DOCUMENTS 4,141,762 2/1979 Yamaguchi et al. ..... 148/38

4,172,716 10/1979 Abo et al. ..... 75/128 E 4,390,367 6/1983 Niehaus et al. ..... 148/38

*Primary Examiner*—Melvyn J. Andrews

*Assistant Examiner*—Deborah Yee

*Attorney, Agent, or Firm*—Oblon, Fisher, Spivak, McClelland, & Maier

[57] ABSTRACT

A nitrogen-containing dual phase stainless steel with high hot workability, containing in percentage by weight:

less than 0.03% of C;
0.3–2.0% of Si;
0.4–4.0% of Mn;
16–22% of Cr;
4–7% of Ni;
2–4% of Mo;
0.06–0.20% of N;
less than 0.005% of S;
0.001–0.01% of Ca in a Ca/S ratio of greater than 1.5;

and the balance of iron and inevitable impurities.

10 Claims, 1 Drawing Figure

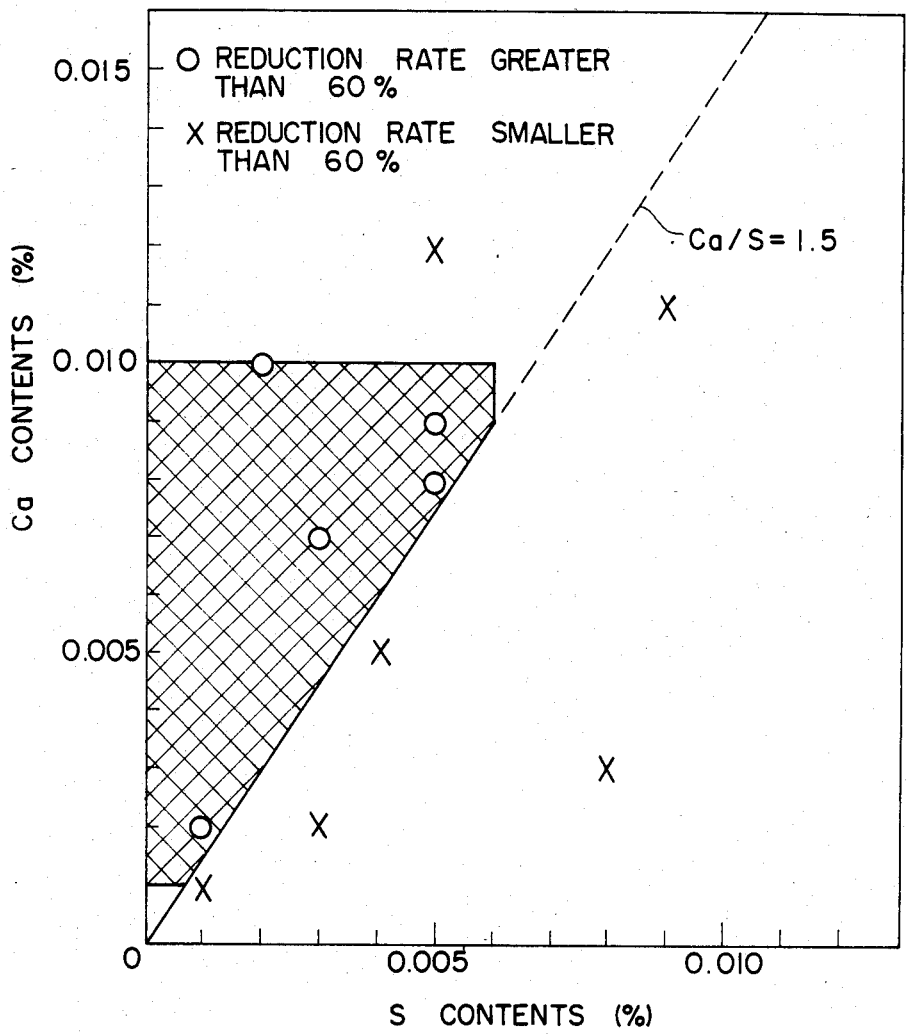
O REDUCTION RATE GREATER THAN 60 %
X REDUCTION RATE SMALLER THAN 60 %
Ca/S= 1.5
0.015
0.010
0.005
0
0.005
0.010
Ca CONTENTS (%)
S CONTENTS (%)

NITROGEN-CONTAINING DUAL PHASE STAINLESS STEEL WITH IMPROVED HOT WORKABILITY

BACKGROUND OF THE INVENTION

1. Field of the Invention

This invention relates to a nitrogen-containing dual phase stainless steel with excellent hot workability.

2. Discussion of the Background

In applications where resistance to stress corrosion cracking is an important factor, for example, in the case of heat exchangers to be used in chemical industries, it has been the conventional practice to employ an ASME SA 669 steel which is a typical dual phase stainless steel. However, a steel of this sort has a problem in that its ferrite content is increased at the time of welding by application of high heat temperature deteriorating the corrosion resistance of the weld including the welding-heat affected zones by precipitating Cr carbides in ferrite grain boundaries upon cooling in a subsequent stage.

In an attempt to prevent deteriorations of the corrosion resistance of the weld, it has been proposed (in Japanese Patent Publication No. 59-5662) to produce a nitrogen-containing dual phase stainless steel in which an austenite phase is reserved in the high-temperature affected zones by addition of N which is an austenite forming element. However, since N is solid-soluble mainly in the austenite phase, this N-containing dual phase stainless steel also has a problem in that cracking is apt to occur at the boundaries of the austenite and ferrite phases due to a large difference in hot deformation resistance therebetween, resulting in inferior hot workability.

In the forging and rolling methods which are generally resorted to for cogging steel ingots, it is essential to employ a rolling method from a practical and economical point of view. Accordingly, the present inventors conducted an extensive study with a view to improving hot workability of nitrogen-containing dual phase stainless steel, and as a result, found that a N-containing dual phase stainless steel capable of blooming and retaining sufficient resistance to stress corrosion cracking could be obtained by restricting the S and Ca contents of the steel in a certain correlation with each other.

SUMMARY OF THE INVENTION

According to the present invention, there is provided an N-containing dual phase stainless steel containing in percentages by weight:

less than 0.03% of C;
0.3% to 2.0% of Si;
0.4% to 4.0% of Mn;
16% to 22% of Cr;
4% to 7% of Ni;
2% to 4% of Mo;
0.06% to 0.20% of N;
less than 0.005% of S;
0.001% to 0.01% of Ca in a Ca/S ratio of greater than 1.5;

and the balance of iron and inevitable impurities.

The above and other objects, features and advantages of the invention will become apparent from the following description and the appended claim, taken in conjunction with the accompanying drawing.

BRIEF DESCRIPTION OF THE DRAWING

In the accompanying drawing:

The sole FIGURE is a graph showing S and Ca contents in various steels in relation to values of reduction rate in high-temperature and high-speed tensile tests.

DETAILED DESCRIPTION OF THE PREFERRED EMBODIMENTS

The present inventors have confirmed that, in order to bloom a N-containing dual phase stainless steel in a temperature range of 950°-1200° C., a specimen sampled from a steel ingot should have a reduction rate greater than about 60% in a high-temperature and high-speed tensile test. The drawing shows the values of reduction rate of steels with different Ca and S contents in a basic composition of 0.02C-20Cr-5Ni-3Mo-0.1N, in a high-temperature and high-speed tensile test in a temperature range of 950°-1200° C. In the drawing, the mark "o" indicates a reduction rate greater than about 60% and the mark "x" a reduction rate smaller than about 60%. As is clear from these test results, in order to secure a reduction rate greater than about 60%, which is necessary for blooming in a temperature range of 950°-1200° C., the steel should contain S in an amount less than 0.005% and Ca in an amount between 0.001-0.01% and in a Ca/S ratio of greater than 1.5 by weight.

On the other hand, the element N, which improves resistance to pitting corrosion, crevice corrosion and general corrosion, is essential especially as an austenite-forming element to secure the corrosion resistance of a welded portion. In order to obtain these effects effectively in the steel of the invention, N should be added in at least 0.06%. However, since N is a gaseous component which might make it difficult to obtain sound steel ingots by causing bubbling in the ingot making stage if added excessively, its additive amount should be limited to 0.20%.

The contents of other alloy components in the nitrogen-containing dual phase stainless steel according to the invention are also restricted for the following reasons.

The component C, if precipitated as $Cr_{23}C_6$ at the grain boundaries, causes intergranular corrosion or intergranular stress corrosion cracking. In order to prevent such corrosion especially at a welded portion, the content of C should be suppressed to a value less than 0.03%.

The component Si which is necessary as a deoxidizer and which is effective for improving the resistance to pitting corrosion and transgranular stress corrosion cracking should be added in at least 0.3%. However, since Si would deteriorate the hot workability if added excessively, the additive amount of Si should be limited to 2.0%.

The component Mn which is also added as a deoxidizer stabilizes the austenite structure and solid-solubility of N in the steel of the invention. For these effects, it should be added in at least 0.4%. However, the additive amount of Mn should be limited to 4.0% since it would deteriorate the hot workability and corrosion resistance if added excessively.

The component Cr is an alloy element which is essential for improving the corrosion resistance in general of the steel and Cr needs to be added in an amount greater than 16% especially for securing corrosion resistance against chlorides. However, the content of Cr should be limited to 22% as an excessive Cr content would deteriorate the toughness by for example, precipitating intermetallic compounds of $\sigma$ phase.

The component Ni is necessary for improving the mechanical properties, workability and corrosion resistance in general of the steel and for producing a dual phase structure of austenite and ferrite in the steel. The Ni content in the steel of the invention is restricted to the range of 4–7% in order to secure a ferrite content of 30–70% which is desirable especially from the standpoint of corrosion resistance.

The component Mo is an essential element for improving the corrosion resistance of the steel, especially the resistance to pitting corrosion, crevice corrosion and general corrosion. In the present invention, at least 2% of Mo is added. However, if added in an excessive amount, Mo would cause embrittling by precipitating intermetallic compounds in a manner similar to Cr, so that its content should be limited to 4% at most.

The invention is more particularly illustrated by the following examples.

EXAMPLES

The dual phase stainless steels with chemical compositions shown in Table 1 were melted in a high frequency induction furnace and cast into ingots of 50 kg. These ingots were each heated at 1250° C. for 10 hours for soaking treatment, and then cut into two strips. Sampling specimens taken from one strip were subjected to a high-temperature and high-speed tensile test and specimens from the other strip were machined into test pieces for use in a stress corrosion crack test.

In the high-temperature high-speed tensile test, the specimens were heated to and retained at the temperatures of 1200° C., 1150° C., 1100° C., 1050° C., 1000° C. or 950° C., and tensioned to fracture at a straining speed of 1.0/sec to determined the reduction rate.

The method of stress corrosion crack test and the procedures employed for preparation of the specimens to be used for the test were as follows. The above-mentioned steel ingots were reduced ultimately to 4 mm thick plates by hot forging, hot rolling and cold rolling, and subjected to a solution treatment by water cooling after heating for 30 minutes at 1050° C. and then to remelting by TIG method to simulate the welded joint. Sampled from these specimens were corrosion test specimens of 2 mm in thickness, 15 mm in width and 65 mm in length, each having a remelt portion at a center portion of its length. Double U-bend test specimens were prepared by bending a pair of superposed test specimens into U-shape and fixing the opposite ends by bolts and nuts of SUS 316. These test specimens were immersed in an aqueous solution of 3% sodium chloride+1/20M sodium sulfate for six weeks at 120° C. to test the stress corrosion cracking.

The results of the high-temperature high-speed tensile test at 950°–1200° C. and the stress corrosion cracking test are shown in Table 2.

TABLE 1

| Steels | Chemical Compositions (wt %) | | | | | | | | | |
|---|---|---|---|---|---|---|---|---|---|---|
| | C | Si | Mn | S | Ni | Cr | Mo | N | Ca | Ca/S |
| *1 | 0.018 | 1.54 | 0.50 | 0.003 | 5.02 | 19.06 | 2.98 | 0.12 | 0.005 | 1.67 |
| 2 | 0.027 | 0.59 | 1.55 | 0.004 | 6.53 | 21.57 | 3.67 | 0.07 | 0.009 | 2.25 |
| 3 | 0.014 | 1.82 | 3.61 | 0.002 | 4.13 | 16.70 | 2.12 | 0.18 | 0.006 | 3.00 |
| **4 | 0.015 | 1.50 | 1.70 | 0.004 | 5.14 | 18.61 | 2.77 | 0.03 | — | — |
| 5 | 0.020 | 1.39 | 1.63 | 0.003 | 6.01 | 19.18 | 2.89 | 0.14 | — | — |
| 6 | 0.017 | 1.47 | 1.75 | 0.003 | 5.44 | 18.05 | 2.96 | 0.12 | 0.003 | 1.00 |

*Steels of the invention
**Comparative steels

TABLE 2

| Steels | Hi-Temp. & Speed Tensile Test | Stress Corrosion Crack Test |
|---|---|---|
| *1 | O | O |
| 2 | O | O |
| 3 | O | O |
| **4 | O | X |
| 5 | X | O |
| 6 | X | O |

In the column of the high-temperature and high-speed tensile test in Table 2, the mark "O" represents a reduction rate greater than about 60% and the mark "X" a reduction rate smaller than about 60% at temperatures of 950°–1200° C. In the column of the stress corrosion cracking test, the mark "O" indicates that no stress corrosion cracking occurred, while the mark "X" indicates that intergranular stress corrosion cracking occurred in the welding-heat affected zones.

As clear from the test results, the steels of the invention all passed the tests.

The comparative steel No. 4 exhibited a reduction rate greater than 60% in the high-temperature and high-speed tensile test but suffered from intergranular stress corrosion cracking in the welding-heat affected zones due to a high nitrogen content. On the other hand, the comparative steel Nos. 5 and 6 with an appropriate N-content were acceptable with respect to the corrosion resistance in welding-heat affected zones, but in some cases exhibited a reduction rate smaller than 60% in the high-temperature and high-speed tensile test, which is unsuitable for application to blooming.

As is clear from the foregoing description, the steel of the present invention has excellent hot workability along with improved corrosion resistance in a chlorides enviroment, so that it can be suitably applied, for example, to heat exchangers to be used in for example, chemical industries.

What is claimed is:

1. A nitrogen-containing dual phase stainless steel with high hot workability, consisting essentially of in percentages by weight:

less than 0.03% of C;
0.3–2.0% of Si;
0.4–4.0% of Mn;
16–22% of Cr;
4–7% of Ni;
2–4% of Mo;
0.06–0.20% of N;
less than 0.005% of S;
0.001–0.01% of Ca in a Ca/S ratio of greater than 1.5; and
the balance of iron and inevitable impurities.

2. The stainless steel of claim 1, wherein the C content is 0.014–0.027% by weight.

3. The stainless steel of claim 1, wherein the Si content is 0.59–1.82% by weight.

4. The stainless steel of claim 1, wherein the Mn content is 0.50–3.61% by weight.

5. The stainless steel of claim 1, wherein the S content is 0.002–0.004% by weight.

6. The stainless stain of claim 1, wherein the Ni content is 4.13–6.53% by weight.

7. The stainless steel of claim 1, wherein the Cr content is 16.70–21.57% by weight.

8. The stainless steel of claim 1, wherein the Mo content is 2.12–3.67% by weight.

9. The stainless steel of claim 1, wherein the N content is 0.07–0.18% by weight.

10. The stainless steel of claim 1, wherein the Ca content is 0.005–0.009% by weight in a Ca/S ratio of 1.67–3.00.

* * * * *